United States Patent [19]

Takagi

[11] 4,169,549

[45] Oct. 2, 1979

[54] CLIPPING HANGER

[76] Inventor: Tosio Takagi, No. 28-4, 2-chome, Shin-takada-cho, Kita-ku, Kitakyushu-shi, Fukuoka-ken, Japan

[21] Appl. No.: 713,874

[22] Filed: Aug. 12, 1976

[30] Foreign Application Priority Data

Aug. 27, 1975 [JP] Japan ..... 50-118378[U]
Oct. 9, 1975 [JP] Japan ..... 50-122805

[51] Int. Cl.[2] ..... A47J 51/142
[52] U.S. Cl. ..... 223/96; 24/84 R
[58] Field of Search ..... 223/91, 96, 93; 211/115; 248/205 A; 24/84 R

[56] References Cited

U.S. PATENT DOCUMENTS

| | | | |
|---|---|---|---|
| 1,474,102 | 11/1923 | Ashmore | 223/96 X |
| 2,526,810 | 10/1950 | Curtis | 24/84 R |
| 3,448,903 | 6/1969 | Snow | 223/96 |
| 3,923,213 | 12/1975 | George et al. | 223/96 |
| 4,044,928 | 8/1977 | Watanabe | 223/96 |

*Primary Examiner*—George H. Krizmanich
*Attorney, Agent, or Firm*—Wenderoth, Lind & Ponack

[57] ABSTRACT

A clipping hanger includes a rod having at one end a hook and at the other end a ball, opposing gripping plates integrally connected to each other by a U-shaped elastic member having an opening at the center thereof, a squeeze arm fixed to each of the gripping plates, a leaf spring bent between the squeeze arms and connected at each end to each of the squeeze arms so as to urge the gripping plates against each other. The ball of the rod is rotatably socketed in the opening of the U-shaped elastic member, and is held by the bent portion of the leaf spring fitted in the opening.

3 Claims, 5 Drawing Figures

CLIPPING HANGER

The present invention relates to a clipping hanger for clothings, sheets and the like.

Washed clothing ordinarily hung on a clothesline by means of clothespins or coat-hangers. When a hard wind is flapping the clothing, it is preferable that it be rotated in any direction so that the resistance against the wind can be reduced and the clothing is prevented from being blown off.

A conventional coat-hanger can be rotated in one direction about a rod having a hook. On the other hand, a conventional clothespin and the like has no mechanism of rotation except that a clothesline attached with clothespins is twisted by the wind.

A primary object of the invention is to provide a clipping hanger which can be rotated in any direction.

A further object of the invention is to provide a clipping hanger having means for holding a hanging rod of a clipping hanger at a desired angle.

A still further object of the invention is to provide a clipping hanger simple in construction and which may be readily produced.

Other objects and features of the invention will be apparent from the following description of the invention with reference to the accompanying drawings, in which.

Throughout the drawings, similar parts and elements are denoted by similar reference numerals.

Figure 1:
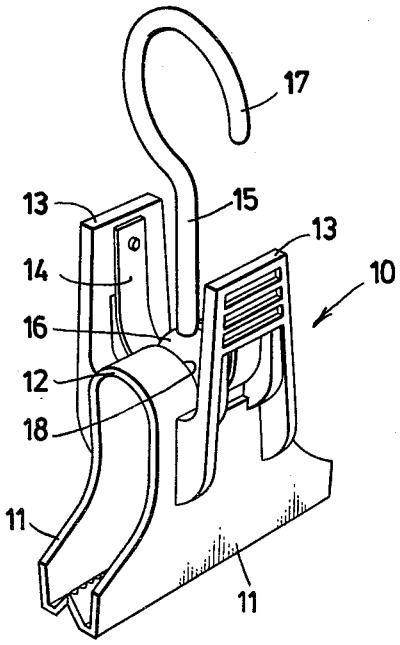
FIG. 1 is a perspective view showing a first embodiment of a clipping hanger of the invention.
Figure 2:
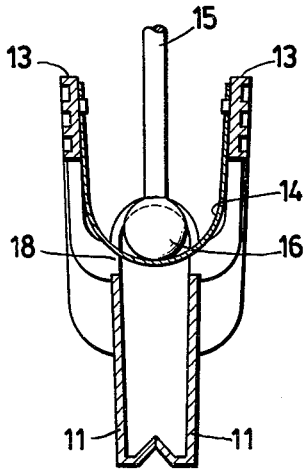
FIG. 2 is a transverse section of the same.
Figure 3:
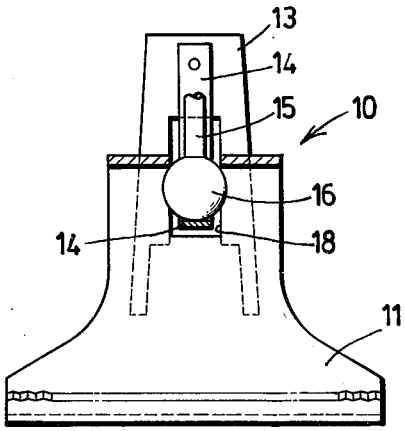
FIG. 3 is a longitudinal section of the same.

Referring now to FIGS. 1 to 3, a clipping hanger of the invention generally indicated at 10 comprises opposing gripping plates 11, 11 integrally connected to each other by a U-shaped resilient member 12. A squeeze arm 13, is fixed to each of the gripping plates 11, a leaf spring 14 bent at the center between said squeeze arms 13, 13 and connected at each end to each of the squeeze arms so as to urge the arms 13 away from each other and press the lower ends (the jaws) of the gripping plates 11 toward to one another. A hanging rod 15 has at one end a ball 16 and at the other end a hook 17.

Preferably, the gripping plates 11, U-shaped member 12 and squeeze arms 13 are integrally formed by molding resilient synthetic resin. However, separate squeeze arms 13 can be fixed to the gripping plates 11 by adhesives or any other known means.

An opening 18 is formed at the center of the U-shaped member 12 into which is fitted a bent portion of the leaf spring 14, as best seen in FIG. 2. The ball 16 of the rod 15 is rotatably socketed in said opening 18 so as not to be removable therefrom. The ball 16 is prevented from falling into the space between the gripping plates 11 by the support of the bent portion of the leaf spring 14, whereby the ball 16 is rotatably held in the opening 18. By this structure, when the clipping hanger 10 of the invention is hung by means of the hook 17 of the rod 15, clothing or the like held by the gripping plates 11 can be rotated in any direction.

Figure 4:
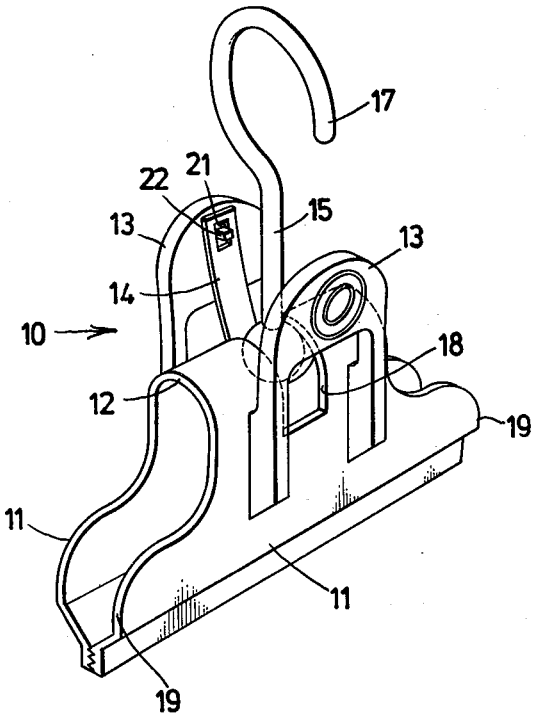
FIG. 4 is a perspective view showing another embodiment of a clipping hanger of the invention.
Figure 5:
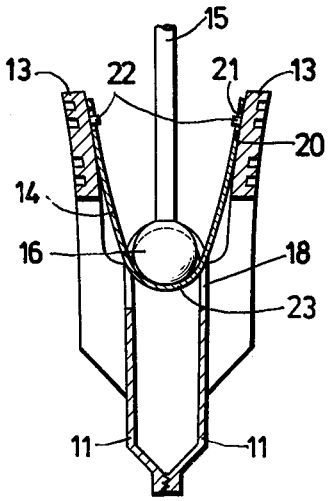
FIG. 5 is a transverse section of the same.

As shown in FIG. 4, side ends 19, 19 of each of the gripping plates 11 can be elongated so as to be usable as a coathanger. Moreover, as appears from FIG. 5, the end portion of each of the squeeze arms 13 can be bent slightly outwardly so as to form a slant 20 at the inner face of each squeeze arm. Each end portion of the leaf spring 14 slidably abuts the slant 20 and is provided with a longitudinal slot 21 in which is slidably fitted a projection 22 provided on the slant 20. When the gripping plates 11 are closed, the ends of the leaf spring 14 slide by its own resiliency upwardly along the slants 20 in the range defined by the slots 21 to cause a U-shaped bent portion 23 of the spring 14 to rise, whereby the ball 16 of the rod 15 is pressed against the inner edges of the opening 18. As a result, the ball 16 is not freely rotatable and the rod 15 can be held at an angle suitable for engaging the hook 15 on, for example, a clothesline.

When the squeeze arms 13 are pressed towards one another so as to open the gripping plates 11 for gripping an article, the slants 20 will incline inwardly towards the fixed ends of the squeeze arms 13, whereby each end of the leaf spring 14 slides downwardly to lower the bent portion 23 thereof and to release the push against the ball 16 of the rod 15. As a result, the ball 16 becomes rotatable.

As described hereinbefore in detail, according to the clipping hanger of the invention, the rod 15 having the hook 17 can be rotated in any direction when the hanger is hung on a clothesline or the like, and therefore is useful for hanging washed clothing or the like.

What is claimed is:

1. A clipping hanger comprising:

a pair of opposing gripping plates;

a resilient U-shaped member between and integrally connecting said gripping plates, said U-shaped resilient member having an opening at the center thereof;

squeeze arm means vertically projecting from each gripping plate for being squeezed together and forcing said gripping plates to spread apart;

leaf spring means fixed at each end to one of said squeeze arm means and having a bent portion in the middle thereof fitted in said opening in said U-shaped member for urging said squeeze arm means apart, whereby urging said squeeze arm means apart forces said gripping plates toward each other; and a rod rotatably fitted through said opening in said U-shaped member, said rod having a hook portion at one end thereof projecting above said opening and a ball portion at the other end thereof rotatably socketed in said opening in said U-shaped member and supported from beneath by said bent portion of said leaf spring means in said opening.

2. A clipping hanger as claimed in claim 1, wherein:

said squeeze arm means slant outwardly away from each other at the upper portion thereof;

said outwardly projecting upper portions of said squeeze arm means have a projection projecting toward said squeeze arm means on the opposite gripping plate; and said leaf spring means has two longitudinal openings, one at each end thereof, each opening slidably engaging one of said projections on said squeeze arm means.

3. A clipping hanger as claimed in claim 1, wherein said gripping plates are elongated at the lower end thereof, whereby said gripping plates are usable as a coathanger.

* * * * *